United States Patent [19]

Van Benthem et al.

[11] 4,129,800

[45] Dec. 12, 1978

[54] GAS AND/OR VAPOR DISCHARGE LAMP

[75] Inventors: Willem Van Benthem; Ernst M. Schmidt, both of Eindhoven, Netherlands

[73] Assignee: U.S. Philips Corporation, New York, N.Y.

[21] Appl. No.: 846,192

[22] Filed: Oct. 27, 1977

[30] Foreign Application Priority Data

Oct. 29, 1976 [NL] Netherlands ..... 7611991

[51] Int. Cl.[2] ..... H01J 61/30

[52] U.S. Cl. ..... 313/25; 313/220; 313/312

[58] Field of Search ..... 313/25, 220, 312, 324

[56] References Cited

U.S. PATENT DOCUMENTS 3,668,390 6/1972 Goossens ..... 313/220

FOREIGN PATENT DOCUMENTS 110747 5/1940 Australia ..... 313/25

815782 7/1959 United Kingdom ..... 313/25

*Primary Examiner*—Palmer C. Demeo

*Attorney, Agent, or Firm*—Robert S. Smith

[57] ABSTRACT

The invention relates to a low-pressure sodium vapor discharge lamp provided with a U-shaped discharge tube which is enveloped by an outer bulb. The bend of that discharge tube is supported by means of a metal element relative to the outer bulb.

In accordance with the invention the bend of the discharge tube is partly passed through a hole in the metal element and bears against two fingers which are part of the metal element.

4 Claims, 2 Drawing Figures

GAS AND/OR VAPOR DISCHARGE LAMP

The invention relates to a gas and/or vapour discharge lamp provided with an elongate discharge tube and an elongate outer bulb enveloping the discharge tube, wherein a portion of the discharge tube is supported relative to the outer bulb by means of a sheet metal element, the metal element cooperating for this purpose with a local change in profile of at least the inside of the outer bulb, wherein the metal element is arranged generally transverse to the longitudinal direction of the outer bulb, the metal element being ring-shaped and provided with strips bent from its plane.

A known discharge lamp of the type indicated is, for example, known from U.S. Pat. No. 2,749,461 (FIG. 9). A disadvantage of that known lamp is that for supporting an end of this discharge tube relative to the outer bulb a plurality of parallel supports is required besides the metal element. This is a disadvantage.

It is an object of the invention to provide for a discharge lamp of the type indicated in the preamble a very simple supporting of the discharge tube relative to the outer bulb.

A gas and/or vapour discharge lamp according to the invention, provided with an elongate discharge tube and an elongate outer bulb enveloping the discharge tube, wherein a portion of the discharge tube is supported relative to the outer bulb by means of a sheet metal element, the metal element cooperating for this purpose with a local change in profile of at least the inner side of the outer bulb, wherein the metal element is arranged generally transverse to the longitudinal direction of the outer bulb, is ring-shaped and provided with strips bent from its plane, is characterized in that said portion of the discharge tube is passed through the metal element and bears against the strips of that element and wherein the ring-shaped portion of the element cooperates with the local change in profile of the outer bulb.

An advantage of a lamp according to the invention is that supporting of said portion of the discharge tube relative to the outer bulb is very simple.

The discharge tube of a lamp according to the invention may, for example, be of a longitudinal form, that is to say a linear discharge tube.

In a preferred embodiment of a discharge lamp according to the invention the discharge tube is U-shaped and said portion of the discharge tube which is passed through the metal element is a portion of the U-bend of that discharge tube.

An advantage of this preferred embodiment is that a U-shaped tube, wich is very difficult to support, is now supported in a simple manner.

In a further improvement of this embodiment the metal element is provided with four strips, two of which bear against the outer curved side of the bend of the discharge tube and two against the inner curved side of the bend of the discharge tube.

An advantage of this preferred embodiment is that a firm mechanical coupling between the discharge tube and the metal element has been realised in a simple manner.

An embodiment of the invention will be further explained with reference to a drawing, in which.

Figure 1:
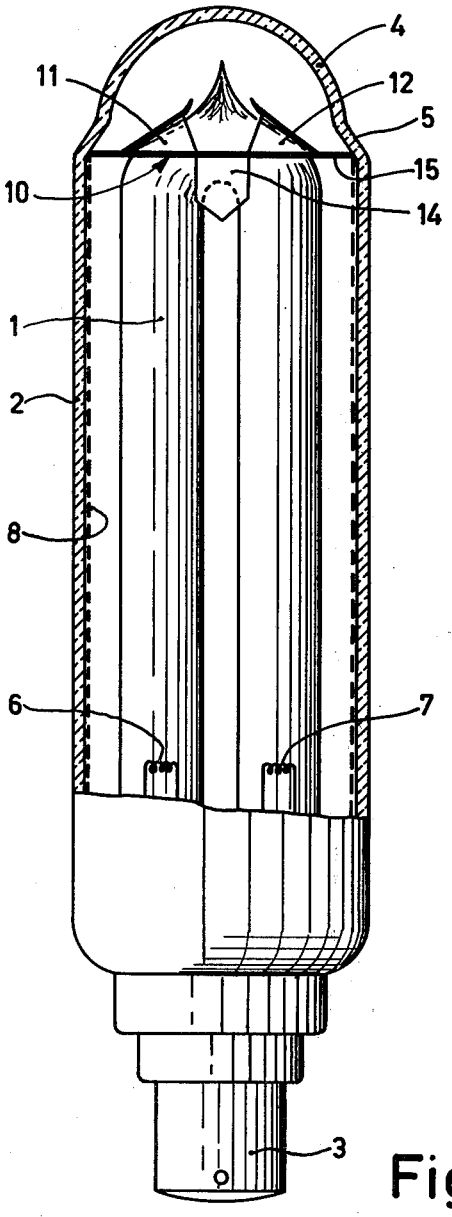
FIG. 1 is a view of a lamp according to the invention, partly with a cut-away outer bulb.

The lamp shown in FIG. 1 is a low-pressure sodium vapour discharge lamp of approximately 18 Watts. Reference 1 indicates a U-shaped discharge tube. Reference 2 indicates an outer bulb which envelopes this tube. The lamp is provided with a lamp base 3. The side of the outer bulb 2 which faces away from the lamp base 3 is provided with a semi-spherical end portion 4. At the transition from the cylindrical portion of the outer bulb to the semi-spherical portion 4 there is a ring-shaped local change in profile 5. Namely, the radius of the semi-sphere is somewhat smaller than the radius of the cylindrical portion of the outer bulb 2. Reference 6 indicates an electrode in an end of the U-shaped discharge tube 1. Reference 7 indicates an electrode in the other end of the discharge tube 1. Both electrodes are connected to respective current supply elements which are part of the lamp base 3. Reference 10 indicates a sheet metal element which is provided with two strips or fingers 11 and 12 which bear against the outer curved surface of the bend of the U-shaped discharge tube 1 and, in addition, with two strips or fingers 13 and 14 which bear against the inner curved side of the bend of the discharge tube 1. See also FIG. 2. A ring-shaped portion 15 of the metal element bears against the transition 5 from the cylindrical portion to the semi-spherical portion of the outer bulb 2.

Figure 2:
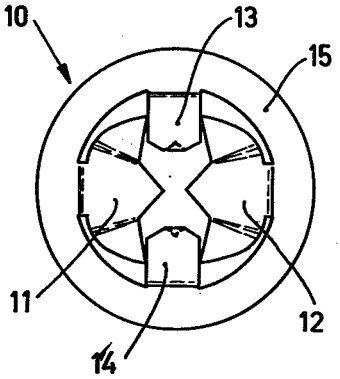
FIG. 2 is a top view of an internal metal supporting element of the lamp of FIG. 1.

FIG. 2 shows metal element 10 as seen from the semisphere 4. This element consists of spring steel of approximately 0.3 mm thick. The lamp of FIG. 1 has a length of approximately 20 cm and the diameter of the outer bulb is approximately 5 cm. The diameter of each of the legs of the discharge tube is approximately 1.5 cm. Besides an excess of sodium the discharge tube also contains a rare gas, namely neon to which 1% argon has been added. The pressure of the rare gas is approximately 8½ Torr. If desired, the discharge tube of the lamp described can also be provided with some small bulges to ensure a uniform distribution of the sodium. The metal element 10 ensures a proper supporting of the discharge tube 1 relative to the outer bulb 2. This metal element 10 also functions as heat shield, as an addition to an infra-red radiating coating 8 which is disposed on the inside of the cylindrical portion of the outer bulb 2. The coating 8 consists of indium oxide which is approximately 0.5 microns thick, the layer being transmissive to visible light produced in the tube 1.

The desired lamp may for example be connected through an inductive impedance to an a.c. power mains.

What is claimed is:

1. A gas and/or vapour discharge lamp which comprises an elongated discharge tube and an elongated outer bulb enveloping said discharge tube, means for supporting a portion of said discharge tube relative to the outer bulb which includes a sheet metal element, at least one local change in profile of at least the inside of said outer bulb, said sheet metal element including a ring shaped part, said ring shaped part cooperating with said local change in profile of at least the inside of said outer bulb, said ring shaped part being disposed generally transverse to the longitudinal direction of said outer bulb, said sheet metal element including a plurality of fingers extending from the plane of said ring metal part, a portion of said discharge tube passing through said sheet metal element and bearing against said fingers of said sheet metal element.

2. A gas and/or vapour discharge lamp as claimed in claim 1 wherein said portion of said discharge tube which is supported by said metal element, is U-shaped.

3. A gas and/or discharge lamp as claimed in claim 2 wherein said metal element has a total of four fingers, two of said fingers bearing against the outer curved side of said U-shaped bend of said discharge tube and two other fingers bearing against the inner curved side of said U-shaped bend of said discharge tube.

4. A gas and/or vapour discharge lamp as claimed in claim 1 wherein said lamp is a low-pressure sodium vapour discharge lamp.

* * * * *